US006483474B1

(12) United States Patent
Desargant et al.

(10) Patent No.: US 6,483,474 B1
(45) Date of Patent: Nov. 19, 2002

(54) REFLECTOR ANTENNA FOR PERFORMING DIPLEXING OF RECEIVED AND TRANSMITTED SIGNALS

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/981,329

(22) Filed: Oct. 16, 2001

(51) Int. Cl.[7] ..... H01Q 19/14

(52) U.S. Cl. ..... 343/781 CA; 343/781 P; 343/840; 343/909

(58) Field of Search ..... 343/756, 781 CA, 343/781 R, 781 P, 782, 840, 909; 342/373, 374; H01Q 19/14

(56) References Cited

U.S. PATENT DOCUMENTS 4,025,783 A * 5/1977 Fletcher et al. ..... 250/199
4,282,525 A * 8/1981 Gustincic et al. ..... 343/781 P
4,284,992 A * 8/1981 Gans ..... 343/909
4,785,310 A * 11/1988 Rosen ..... 343/909
5,204,686 A * 4/1993 Petrelis et al. ..... 342/374
5,576,721 A * 11/1996 Hwang et al. ..... 343/753
6,252,559 B1 * 6/2002 Donn ..... 343/781 CA

* cited by examiner

*Primary Examiner*—Tho G. Phan
(74) *Attorney, Agent, or Firm*—Harness, Dickey & Pierce, P.L.C.

(57) ABSTRACT

A reflector antenna system having a diplexer for providing isolation between transmitted and received signals, which eliminates the need for a diplexer to be inserted into the waveguide or coax transmission line coupling the antenna system with an external antenna electronics subsystem. The antenna system includes a main reflector to which is coupled a low effective dielectric tube. Transmit and receive feedhorns are supported within the tube. A hyperboloidal receive bandpass filter is supported in front of the receive feedhorn and a hyperboloidal transmit bandpass filter is disposed in front of the transmit feedhorn. The receive bandpass filter allows the received signal to pass therethrough but blocks the transmitted signal from the transmit feedhorn. Conversely, the transmit bandpass filter reflects the received signal received from the subreflector surface back towards the receive feedhorn while allowing the transmitted signal from the transmit feedhorn to pass therethrough.

18 Claims, 2 Drawing Sheets

REFLECTOR ANTENNA FOR PERFORMING DIPLEXING OF RECEIVED AND TRANSMITTED SIGNALS

FIELD OF THE INVENTION

This invention relates antenna systems, and more particularly to a reflector antenna capable of performing diplexing of received and transmitted signals as the signals are radiated through air.

BACKGROUND OF THE INVENTION

With typical, present day Cassegrain reflector antenna systems, as shown in FIG. 1, a single feedhorn is employed in connection with a main reflector. The single feedhorn is used to receive signals reflected by a subreflector as well as to radiate a transmitted signal toward the subreflector, which is reflected by the subreflector back toward the main reflector, and subsequently reflected by the main reflector back into space.

The use of a single feedhorn required to perform both transmit and receive functions requires the use of a diplexer circuit to be installed in the waveguide or coax transmission line which is coupled to the feedhorn. The diplexer circuit is necessary to isolate the receive and transmit signals. In actual practice, the diplexer must be constructed within the physical dimensions of the waveguide or coax transmission line. With a WR75 waveguide, this requires the diplexer to be constructed within a cross sectional area of about 0.75 inch (19.05 mm) width and 0.375 inch (9.53 mm) height. As will be appreciated, these very small dimensions impose significant design restraints on the diplexer circuit and add to the difficulty in achieving the needed isolation between the transmit and receive signals. Waveguide, coax or microstrip diplexer components also have a higher loss which must be factored into the design of the electronics operating in connection with the antenna system.

Accordingly, there is a need for an antenna system which allows the transmit and receive signals to be separated without the use of a conventional diplexer circuit being placed in the transmission line communicating with the antenna. More specifically, there is a need for a reflector antenna system which is capable of isolating (i.e., diplexing) the transmit and receive signals while these signals are radiating through space. Such an antenna system would alleviate the above-described space constraints associated with present day diplexer circuits required to be disposed in the transmission line. Such a system would also provide less loss and better isolation of the transmit and receive signals, thus potentially resulting in the need for less expensive electronic circuitry being used to operate with the reflector antenna system.

SUMMARY OF THE INVENTION

The present invention is directed to a reflector antenna system which is operable to isolate receive and transmit signals being received and transmitted, respectively, by the antenna system while the signals are radiating through free space. The antenna system of the present invention thus eliminates the need for a conventional diplexer circuit to be included in the transmission line coupled to the antenna system.

In one preferred embodiment the antenna system of the present invention comprises a main reflector, a receive feedhorn and a transmit feedhorn spaced apart from the receive feedhorn. A receive bandpass filter is disposed adjacent the receive feedhorn and a transmit bandpass filter is disposed adjacent the transmit feedhorn. The receive bandpass filter allows a propagating electromagnetic wave having a first frequency to pass therethrough, but prevents an electromagnetic wave radiated from the transmit feedhorn, having a second frequency, which is different from the first frequency, from passing therethrough into the receive feedhorn. The hyperboloidal surface of the receive bandpass filter, in effect, scatters or reflects the transmitted electromagnetic wave isotropically to reduce its reflection back toward the transmit feedhorn. Thus, the receive bandpass filter serves to isolate the receive feedhorn from the signal radiated by the transmit feedhorn.

The transmit bandpass filter operates in the opposite fashion. The transmit bandpass filter operates to reflect an electromagnetic wave reflected by the main reflector back toward the receive feedhorn, where the propagating wave is then able to pass through the receive bandpass filter and be received by the receive feedhorn. Thus, the transmit bandpass filter isolates the transmit feedhorn from the receive signals reflected by the reflector.

In one preferred form, the transmit feedhorn, the receive feedhorn, the transmit bandpass filter and the receive bandpass filter are all supported by a tubular support, wherein the tubular support is supported adjacent a reflecting surface of the main reflector. This construction removes the tolerance constraints that are present when designing a diplexer which must fit within a waveguide or coax transmission line, as with previously developed Cassegrain reflector antenna systems. The use of the receive and transmit bandpass filters, which perform a diplexing function on the received and transmitted electromagnetic waves, also improves the isolation between the receive and transmit signals.

In the preferred embodiments the transmit bandpass filter, which functions as the subreflector, comprises a hyperbolic shape. Each of the transmit bandpass and receive bandpass filters include suitable multi-layer, frequency selective surfaces designed to pass therethrough a signal having a desired frequency. Thus, the receive bandpass filter is designed to pass only a signal having a first frequency, while the transmit bandpass filter is designed to pass only a signal having a second frequency which is different than the first frequency. In one preferred form, the receive bandpass filter is designed to pass a received signal having a frequency of about 12.7 GHz. In one preferred from, the transmit bandpass filter is designed to pass a signal radiated from the transmit feedhorn having a frequency of approximately 14.0 GHz.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 2:
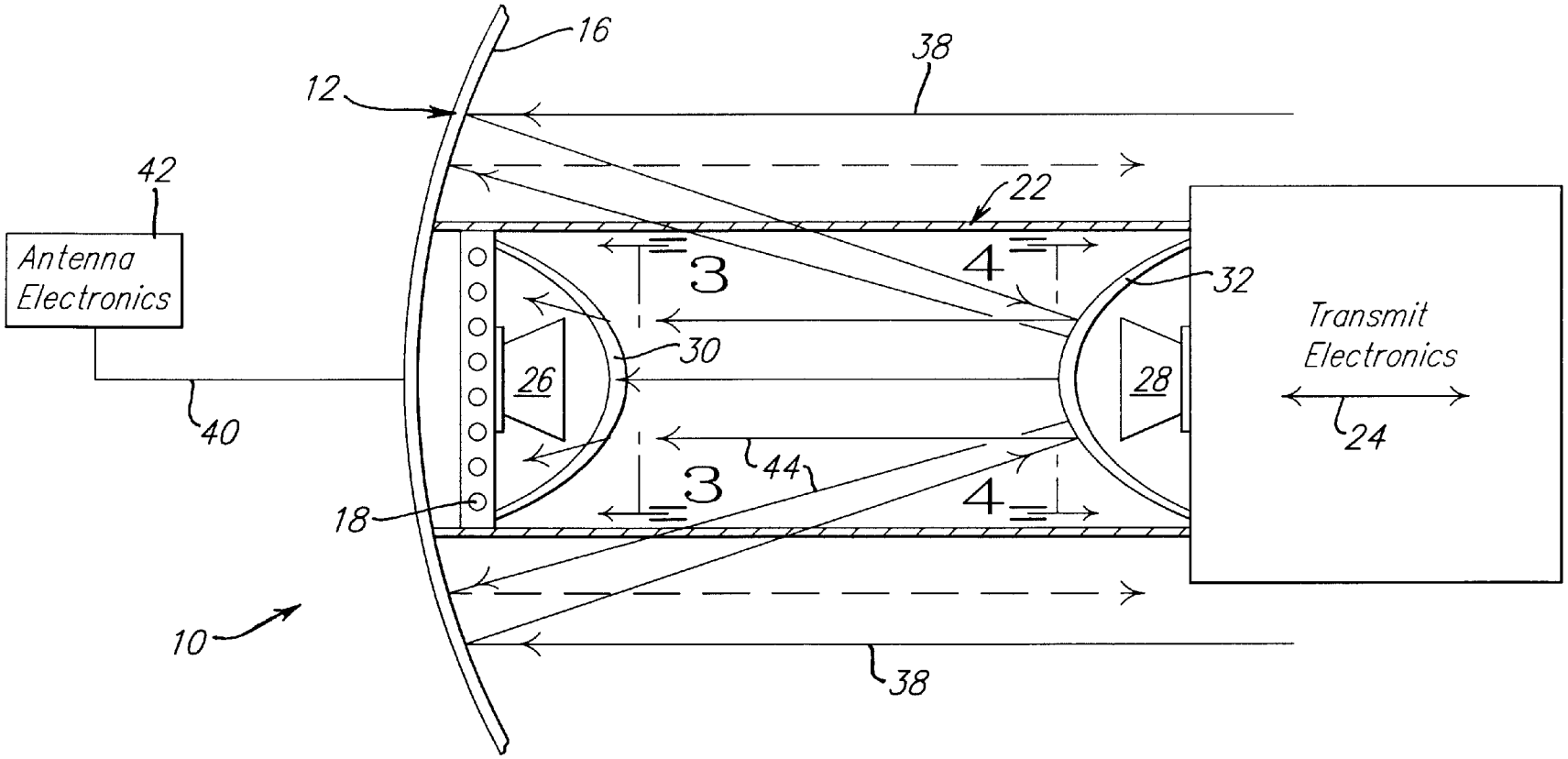
FIG. 2 is a side, partial cross sectional view of a reflector antenna system in accordance with a preferred embodiment of the present invention.

Referring to FIG. 2, there is shown an antenna 10 in accordance with a preferred embodiment of the present invention. The antenna system 10 is in the form of a Cassegrain reflector antenna system and generally comprises a main reflector 12 and a diplexer subsystem 14 supported from a reflector surface 16 of the main reflector 12. The diplexer 14 is supported by one or more fasteners 18 secured to a flange or bracket 20, which is in turn secured to the reflector surface 16. The main reflector 12 forms a conventional parabolic dish reflector which may vary widely in diameter, as required for a specific application.

The diplexer 14 comprises a low effective dielectric, elongated tube or housing 22 which is secured to the flange 20 via the fasteners 18. The tube 22 is further disposed preferably along an axial center, represented by axis 24, of the main reflector 12. The tube 22 supports therein a receive feedhorn 26 which is supported within the tube 22 by any suitable bracket or mounting hardware and disposed forwardly of the reflector surface 16 along the axial center 24 of the main reflector 12. A transmit feedhorn 28 is also disposed within the tube 22 and similarly supported by any suitable mounting hardware so as to be spaced apart from the receive feedhorn 26, forwardly of the receive feedhorn, and at the approximate axial center 24 of the main reflector 12.

The tube 22 further supports therein a receive bandpass filter 30, preferably in the shape of a hyperbolic dish, which is disposed forwardly of the receive feedhorn 26 within the tube 22. A transmit bandpass filter 32 is disposed forwardly of the receive feedhorn 26 and inbetween the receive bandpass filter 30 and the transmit feedhorn 28. The transmit bandpass filter 32 is also formed in the shape of a hyperbolic dish having a diameter preferably small enough so that it can be supported within the tube 22. The axial center of each of the bandpass filters 30 and 32 are also disposed along axial center 24 of the main reflector 12.

Figure 1:
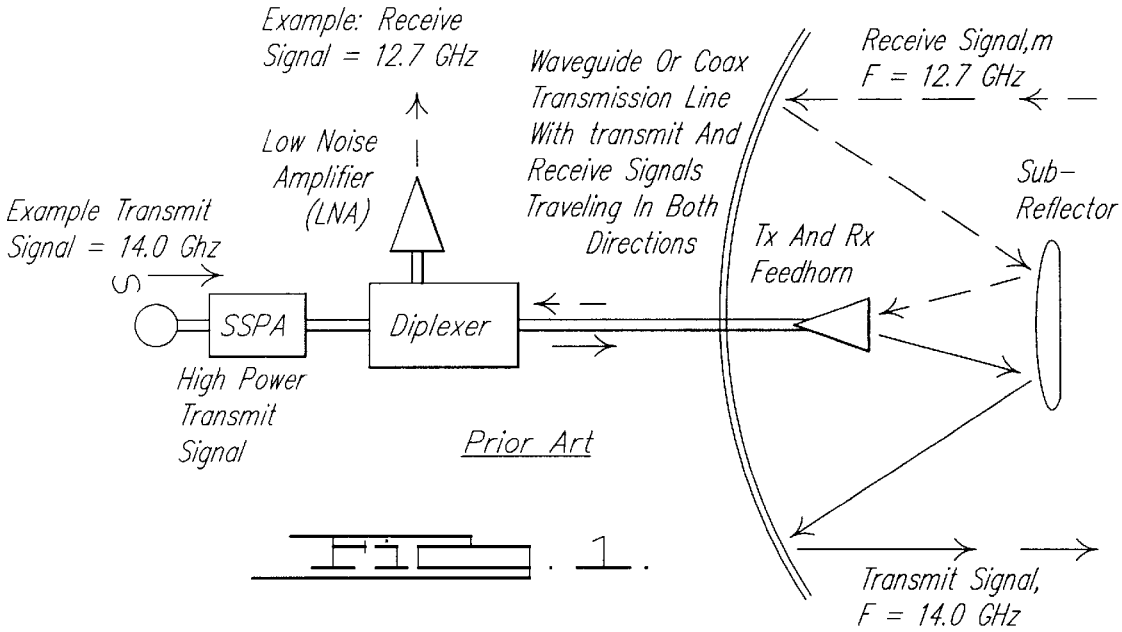
Prior Art FIG. 1.
FIG. 1 is a simplified drawing of a prior art Cassegrain antenna illustrating a prior art diplexer being inserted in a waveguide or coax transmission line coupled to the Cassegrain antenna.
Figure 3:
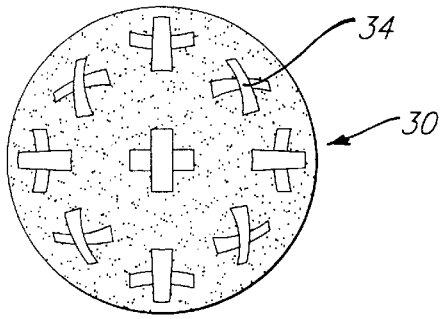
FIG. 3 is a plan view of the receive bandpass filter taken in accordance with directional line 3—3 in FIG. 2.
Figure 5:
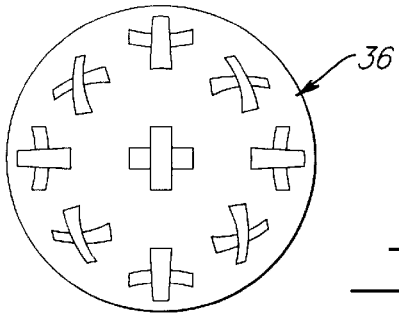
FIG. 5 is a plan view of an alternate transmit bandpass rejection filter which may be substituted for the receive bandpass filter of FIG. 3.

With reference to FIG. 3, the receive bandpass filter 30 can be seen in greater detail. The receive bandpass filter 30 comprises a multi-layer, frequency selective surface which allows an electromagnetic wave having a predetermined frequency to pass therethrough, while blocking electromagnetic waves outside of the selected frequency. In one preferred form, the receive bandpass filter 30 allows a signal having a frequency of 12.7 GHz to pass therethrough while excluding signals at other frequencies. The receive bandpass filter 30 accomplishes this by the use of a large plurality of very small openings 34 which are desired to pass only signals having the desired frequency. Referring briefly to FIG. 5, it will be appreciated that the same effect can be obtained through the use of a transmit band reject filter 36. The transmit band reject filter 36 would be tuned to reject all signals except those having a particular, desired frequency. It would be constructed in the same fashion and would comprise a multi-layer, planar component having a plurality of frequency selective surfaces.

Figure 4:
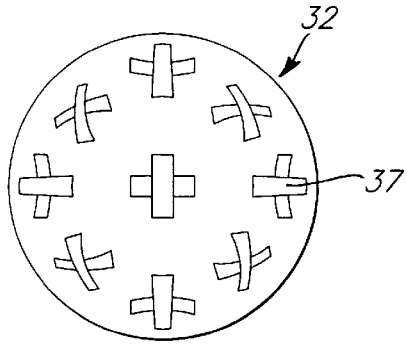
FIG. 4 is a plan view of the transmit bandpass filter taken in accordance with directional line 4—4 in FIG. 2.

Referring to FIG. 4, the transmit bandpass filter 32 is shown in greater detail. Since this filter is shaped in the form of a hyperbolic dish, it is able to perform the subreflector function needed in a Cassegrain reflector antenna system. The transmit bandpass filter 32 comprises a component having a plurality of frequency selective surfaces having openings 37 which pass an electromagnetic wave having a predetermined frequency while rejecting signals at other frequencies. In one preferred form the transmit bandpass antenna 32 passes a signal having a frequency of 14.0 GHz.

A principal advantage of the diplexer 14 is that since the components within the diplexer can be formed much larger in scale, tolerances are not nearly as critical as would be the case with a conventional diplexer. With a conventional diplexer, which is required to be inserted in a waveguide or coax transmission line, dimensional tolerances become of critical importance. The diplexer 14, however, in one preferred form comprises a diameter of about 4 inches which significantly reduces the criticality of the tolerances of the various components which form the diplexer.

In operation, a receive signal representing a signal 38 in the form of a propagating electromagnetic wave having a first frequency, is received and reflected by the reflecting surface 16 of the main reflector 12 toward the transmit bandpass filter 32. The transmit bandpass filter 32, being constructed so as to pass only signals at a particular transmit frequency (which is different than the frequency of the received signal 38) reflects the received signal 38 toward the receive feedhorn 26. The received signal 38 is able to pass directly through the receive bandpass filter 30 and into the receive feedhorn 26 where it is then transmitted via a transmission line 40 a suitable antenna electronics subsystem 42 in communication with the antenna system 10. Thus, the transmit bandpass filter 32 isolates the transmit feedhorn 28 from the receive signal 38.

The transmit feedhorn 28 also operates to radiate a signal 40 in the form of an electromagnetic wave having a second frequency, which is different than the frequency of the received signal 38, toward the reflector 12. The transmitted signal 44 is able to pass through the transmit bandpass filter 32 and a portion of this signal is blocked by the receive bandpass filter 30 from entering the receive feedhorn 26. However, the great majority of the transmitted signal 44 irradiates the reflector surface 16 and is reflected thereby into free space. Thus, the receive bandpass filter 30 operates to isolate the receive feedhorn 26 from the transmitted signal 44. This construction further operates to selectively improve the isolation of the received signal 38 from the transmitted signal 44. As will be appreciated, this is very important because the receive feedhorn 26 will typically be attempting to receive signals having a strength of much less than one watt, while the transmit feedhorn 28 may be transmitting a signal much greater than one watt, and often between 10–20 watts or even higher in magnitude. Without the ability to isolate the receive feedhorn 26 from the transmitted signal 44, the received signal 38 would be easily drowned out or masked by the transmitted signal 44.

The present invention 10 thus form a means to isolate transmitted and received signals while these signals are propagating in free space. The diplexer 14 of the antenna system 10 provides a means to accomplish this in a manner which does not significantly complicate the construction of a Cassegrain type reflector antenna system, and without adding significant additional cost to such an antenna system. The antenna system 10 of the present invention further eliminates the need to use a diplexer circuit in the transmission line coupling the antenna system 10 to external antenna electronics and can further achieve improved isolation of the transmitted and received signals.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A reflector antenna operable to separate receive and transmit signals, to thereby also perform a diplexing function, said antenna comprising a main reflector having a curved reflector surface;

a receive feedhorn supported closely adjacent and forwardly of said curved reflector surface;

a transmit feedhorn supported at a position forwardly of said receive feedhorn;

a receive bandpass filter disposed adjacent said receive feedhorn and inbetween said receive feedhorn and said transmit feedhorn, for passing therethrough a receive signal having a first frequency, and rejecting a transmit signal from said transmit feedhorn, wherein said transmit signal has a second frequency different than said first frequency; and a transmit bandpass filter disposed inbetween said receive bandpass filter and said transmit feedhorn for operating as a subreflector to reflect said receive signal thereof of toward said receive feedhorn, and for allowing said transmit signal from said transmit feedhorn to pass therethrough.

2. The antenna of claim 1, further comprising a tube within which said transmit feedhorn and said receive feedhorn are supported, said tube being secured at one end thereof to said curved reflector surface.

3. The antenna of claim 2, wherein said tube comprises a low effective dielectric tube.

4. The antenna of claim 1, wherein said transmit bandpass filter comprises a hyperboloidal dish subreflector.

5. The antenna of claim 1, wherein said transmit feedhorn, said receive feedhorn, said transmit bandpass filter and said receive bandpass filter are all axially aligned with an axial center of said main reflector.

6. A reflector antenna operable to diplex received and transmitted signals, said antenna comprising a main reflector having a curved reflector surface;

a support member extending outwardly of said curved reflector surface;

a receive feedhorn supported from said support member adjacent said curved reflector surface;

a transmit feedhorn supported at a position forwardly of said receive feedhorn;

a receive bandpass filter disposed inbetween said receive feedhorn and said transmit feedhorn and supported by said support member, for passing therethrough a receive signal having a first frequency, and rejecting a transmit signal from said transmit feedhorn, wherein said transmit signal has a second frequency different than said first frequency; and a transmit bandpass filter disposed forwardly of said receive feedhorn and supported by said support member for operating as a subreflector to reflect said receive signal thereof of toward said receive feedhorn, thereby isolating said receive signal from said transmit feedhorn, and for allowing said transmit signal from said transmit feedhorn to pass therethrough and be directed at said main reflector.

7. The antenna of claim 6, wherein said support member comprises an elongated tube, and wherein said receive bandpass filter, said transmit bandpass filter, said receive feedhorn and said transmit feedhorn are disposed within said elongated tube.

8. The antenna of claim 7, wherein said elongated tube comprises a low dielectric tube.

9. The antenna of claim 6, wherein said receive bandpass filter comprises a hyperboloidal dish shape.

10. The antenna of claim 6, wherein said transmit bandpass filter forms a hyperbolodoidal dish shape.

11. A reflector antenna having a diplexer for isolating transmit and receive signals, said antenna comprising:

a main parabolic dish reflector having a reflector surface;

a receive feedhorn supported at a point along an approximate axial center of said main parabolic dish reflector for receiving a receive signal having a first frequency;

a transmit feedhorn supported at a point along said approximate axial center for radiating a transmit signal having a second frequency different from said first frequency toward said reflector surface;

a receive bandpass filter disposed along said approximate axial center for passing said receive signal therethrough and isolating said transmit signal from said receive feedhorn; and a transmit bandpass filter formed in the shape of a hyperboloidal dish and disposed adjacent said transmit feedhorn for passing said transmit signal from said transmit feedhorn therethrough but reflecting said receive signal impinging thereon from said main parabolic dish reflector back toward said receive feedhorn, wherein said receive signal is able to pass through said receive bandpass filter into said receive feedhorn.

12. The antenna of claim 11, further comprising a support element supported from said reflector surface of said parabolic dish reflector, for supporting at least one component of the group of said transmit feedhorn, said receive feedhorn, said receive bandpass filter and said transmit bandpass filter thereon.

13. The antenna of claim 12, wherein said support element comprises a low effective dielectric tube, and wherein said one supported component is supported within an interior area of said tube.

14. A method for diplexing receive and transmit radio frequency (RF) signals, comprising the steps of:

providing a main, parabolic reflector;

using a receive feedhorn to receive an RF signal from a remote transmitting source;

using a transmit feedhorn to radiate a transmit RF signal toward said main, parabolic reflector, wherein said transmit RF signal is reflected by a portion of said main, parabolic reflector back into space;

using a receive bandpass filter to pass said RF signal from said remote transmitting source into said receive feedhorn, and to isolate said receive feedhorn from said transmit RF signal being radiated by said transmit feedhorn; and using a transmit bandpass filter as a subreflector to pass said transmit RF signal from said transmit feedhorn therethrough, and to isolate said transmit feedhorn from said RF signal from said remote transmitting source by causing said RF signal irradiating said transmit bandpass filter to be reflected off of said transmit bandpass filter toward said receive feedhorn.

15. The method of claim 14, wherein the step of using said transmit bandpass filter comprises the step of using a hyperboloidal transmit bandpass filter.

16. The method of claim 14, wherein the step of using said receive bandpass filter comprises the step of using a hyperboloidal receive bandpass filter.

17. The method of claim 14, further comprising the step of aligning said transmit and receive feedhorns along an axial center of said main, parabolic reflector.

18. The method of claim 17, further comprising the step of aligning said receive bandpass filter and said transmit bandpass filter along said axial center of said main, parabolic reflector.

* * * * *